United States Patent [19]

Braun

[11] Patent Number: 4,865,057

[45] Date of Patent: Sep. 12, 1989

[54] APPARATUS AND METHOD FOR MAKING HAIRPIECES UNDETECTABLE

[76] Inventor: Edward H. Braun, 6603 Old Stage Rd., Rockville, Md. 20852

[21] Appl. No.: 55,159

[22] Filed: May 28, 1987

[51] Int. Cl.[4] ..... A41G 5/00

[52] U.S. Cl. ..... 132/201; 132/200; 132/213

[58] Field of Search ..... 132/5, 53, 54, 55, 200, 132/201, 212, 213, 319, 333

[56] References Cited

U.S. PATENT DOCUMENTS

| | | | |
|---|---|---|---|
| 1,464,089 | 5/1923 | Ernest | 132/53 |
| 1,906,954 | 5/1933 | Firestein | 132/54 |
| 2,604,104 | 7/1952 | Perlin | 132/53 |
| 2,842,142 | 7/1958 | Peck | 132/88.5 |
| 3,077,891 | 2/1963 | Lane | 132/53 |
| 3,189,035 | 6/1965 | Heck | 132/53 |
| 3,472,246 | 10/1969 | Ostrom | 132/53 |
| 3,483,875 | 12/1969 | Trissell | 132/53 |
| 3,557,803 | 1/1971 | Bosshard | 132/53 |
| 3,589,376 | 6/1971 | Kohler | 132/53 |
| 3,718,145 | 2/1973 | Chateau | 132/88.5 |

FOREIGN PATENT DOCUMENTS

| | | | |
|---|---|---|---|
| 1276929 | 6/1972 | United Kingdom | 132/53 |

OTHER PUBLICATIONS

*Modern Beauty Shop,* vol. 1, p. 96, May 1950, "Truecut Banshaper".

*Primary Examiner*—Gene Mancene
*Assistant Examiner*—Adriene J. Lepiane

[57] ABSTRACT

Heretofore it has not been fully appreciated that in order to make a hairpiece undetectable it must be possible to position the hairpiece on the head of the wearer with a precision which is nothing short of incredible. However, once correct positioning has been achieved, other factors which were previously thought to affect detectability turn out to be relatively unimportant.

A removable rigid mask is fabricated to partially cover and precisely fit the temples and forehead of the hairpiece wearer. A transferable marking is placed on the wearer's head along the base or edge of the hairpiece, and the marking is transferred to the rigid mask. The mask is then cut along the marking, and the edge of the resulting cut mask is utilized to align with the base or edge of the hairpiece to provide a simple, rapid, and precise method for repeatably putting on the hairpiece with the precision required to make the hairpiece appear natural and undetectable.

13 Claims, 3 Drawing Sheets

APPARATUS AND METHOD FOR MAKING HAIRPIECES UNDETECTABLE

BACKGROUND—FIELD OF INVENTION

This invention relates to hairpieces, wigs, toupees, and similar devices which are intended to augment, cover, or replace the hair on a human head, and more specifically, to the accurate positioning of such devices to provide a completely natural appearance.

BACKGROUND—THE PROBLEM

Many male celebrities wear hairpieces, wigs, toupees, and similar devices (hereinafter collectively referred to as "hairpieces") when on stage or on camera to cover up varying degrees of hair loss. However, very few wear their hairpieces off stage or off camera, and many ultimately even give up wearing them on stage or on camera. Correspondingly, relatively few men in the general population wear hairpieces. The reason for this lackluster performance of hairpieces is simple: it is almost impossible to put on a man's hairpiece day after day so that it is undetectable. And, when a man's hairpiece is detectable as such, he immediately becomes the subject of ridicule and derision. One celebrity appeared on a talk show recently bemoaning the fact that when he wears his expensive hairpieces, people keep staring at his hairpiece instead of at him. As a result he simply discontinued wearing the hairpieces. Others keep switching from one style hairpiece to another in an effort to find one which is undetectable.

The problem of detectability is less acute in the case of women because, first of all, their hair styles make it easier to produce an undetectable hairpiece. Secondly, even if a woman's hairpiece is detected as such, people accept the fact that "women wear wigs", and are less inclined to ridicule. While the instant invention is most useful in the case of men's hairpieces, it will become apparent that it can be used to advantage with women's hairpieces as well.

Most people find it difficult to comprehend the fact that it is almost impossible to make a man's hairpiece undetectable. In fact, they think it should be easy to do. After all, men wear their hair in many different styles, they have widely varying amounts of hair, they have different hairlines, they part their hair differently, etc., so one would think that "almost anything should do", that is, if you place a hairpiece on a head in almost any reasonable way, it should be accepted as real. That is why, when they see hair which is obviously bogus, they laugh and ridicule. They think the wearer must be a complete idiot if he cannot do a "simple" thing like put a hairpiece on correctly.

BACKGROUND—THE UNEXPECTED REASON FOR THE PROBLEM

To understand the real state of affairs, one must ignore the fact that men wear their hair in many different styles, have widely varying amounts of hair, different hairlines, etc. This is all irrelevant. What is relevant is the incredible recognitive ability that human beings have. For example, one can look at identical twins and tell them apart. In this case, how much difference is there in the position and shape of the eyes, nose, mouth, and other features? Or, one can see a person coming down the street two blocks away and recognize who it is. Since these things are so easy for us to do, we take them for granted. But it is impossible even for the most sophisticated computer in existence today to come close to performing these fantastic feats of recognition that we human beings perform routinely.

This pinpoints exactly the problem with hairpieces. Human beings unconsciously bring this highly developed recognitive ability to bear when they look at someone's hair and make a decision as to whether it is real or not. They consider the texture, the color, the shape, the sheen, the positioning of the hair on the head, etc. If one visits hair salons that sell men's hairpieces and asks "Do you guarantee your hairpieces to be undetectable?", the universal answer is "No, because detectability depends on how you care for the hairpiece." The operators of these salons are undoubtedly very sincere in their response and believe they are telling the truth, but the fact is that, unless it is badly abused, how you care for a hairpiece has very little to do with its detectability. Extensive experiments by the applicant have shown that with modern hairpieces, whether made from real or synthetic hair, the all important factor is the absolutely accurate positioning of the hairpiece on the head of the wearer. This positioning must be so incredibly precise that it is literally almost beyond human comprehension. It is this fact that has not been fully appreciated in the past. As a result, many people have spent large amounts of money on expensive, carefully constructed custom hairpieces in a vain attempt to make them undetectable. In so doing, they are only improving the appearance of the hair itself, but they are not solving the real problem, that of extremely accurate positioning. In fact, once a hairpiece is accurately positioned, other factors which were formerly thought to be important in causing detection of hairpieces turn out to play a minor role. A very inexpensive hairpiece, even one in relatively poor condition, can be undetectable if properly positioned on the head. On the other hand, a very expensive hairpiece, in the best of condition, not properly positioned, can be recognized as bogus from a distance of as much as a hundred feet or more.

Professional hair stylists and theatrical makeup artists are somewhat more successful in making hairpieces undetectable, but their methods and objectives are not adaptable to everyday use. First of all, they are able to stand back and evaluate their placement of a hairpiece from all different angles with a professional eye, something a lay person cannot do. Secondly, they frequently compensate for imperfect placement of the hairpiece by fluffing up or reshaping the hair itself, or by brushing the hair out over the edges of the hairpiece, etc., and then spraying it to hold it in place. This procedure may be satisfactory for brief appearances on stage or screen, where there is no wind, relatively little physical activity, and where the appearance of the hairpiece is continually monitored by professional makeup people and modified at intervals as may be required. However, it is totally unsatisfactory for everyday use, because the fluffed up hair tends to settle after a short time, or the brushed out hair blows in the wind, etc. Anyone who has worn a hairpiece knows that it may be satisfactory for an hour or two, and then suddenly everyone begins recognizing it as bogus. This is due to the aforementioned settling, blowing, etc., which need only be miniscule to make the hairpiece detectable. On the other hand, if the placement of the hairpiece is absolutely correct, it can be subject to considerable blowing, settling, etc., and it will still remain undetectable, assuming of course that the hairpiece is properly designed to begin with.

The position of a hairpiece on the head can be specified by giving three angles of rotation about three mutually perpendicular axes. This is analogous to roll, pitch, and yaw in a spacecraft. Experiments have shown that all three of these angles must simultaneously be correct to within less than about one degree, otherwise the hairpiece can begin to be detectable. This translates roughly into a precision of better than 1/16th of an inch in positioning the edges of the hairpiece. It is virtually impossible for someone to consistently place a hairpiece on his head day in and day out with this kind of precision. Furthermore, it is extremely frustrating to try. No matter what one does, the hairpiece never seems to look right. In addition, it should be realized that if a hairpiece is detected on even a single occasion, people will know that the wearer is wearing a hairpiece forever after, even if it is subsequently worn in such a manner as to be undetectable. This is why most people simply discard their hairpieces, and why men's hairpieces have gotten such a bad reputation.

BACKGROUND—PREVIOUS ATTEMPTS AT A SOLUTION

Several attempts have been made in the past to overcome the critical problem of positioning a hairpiece, even though the true magnitude of the problem was not fully realized.

R. Ernest (U.S. Pat. No. 1,464,089) disclosed a method for manufacturing a hairpiece utilizing a plastic foundation moulded to the head of the wearer with the individual hairs inserted into the plastic foundation. Although this device has the potential to hold the hair in a precise position and has been sporadically available commercially during the many years since the patent was issued, it is not a satisfactory solution. Once the foundation has been cast and the hairpiece made, if it does not turn out to be accurately positioned it can no longer be repositioned to make the hairpiece undetectable. It is expensive to manufacture, and worst of all, it does not provide adequate ventilation for the scalp.

Other attempts have been made to overcome the positioning problem by fastening the hairpiece permanently or semipermanently to the wearer's head.

In one method, sutures are surgically implanted in the wearer's scalp, and the hairpiece is attached to the sutures. This method can provide accurate positioning, but has serious drawbacks. Among them are bleeding at the sutures, possible infection, and danger of serious injury to the scalp if the hairpiece should accidentally be pulled from the head. There is also a hygienic problem, since the hairpiece cannot easily be removed so that the scalp can be washed regularly. In addition, being a surgical procedure, it is expensive and carries with it the usual risks of surgery.

In another method, usually called "hairweaving", a base material is woven to the wearer's own natural hair, and the hairpiece is attached to this base. This initially provides accurate positioning, but again there are serious drawbacks. Since the wearer's own natural hair grows at the rate of approximately one half inch per month, the hairpiece quickly becomes loose and loses its accurate positioning. It is necessary for the wearer to visit a hair salon approximately once a month to have the appliance tightened up. This is inconvenient, time consuming, and expensive. The initial application is also expensive. Since the hairpiece cannot easily be removed, the same hygienic problem of keeping the scalp clean exists as in the case of the sutures.

OBJECTS AND ADVANTAGES

The fact that these expensive, inconvenient, time consuming, and even dangerous methods are in use indicates the need for an accurate and simple method for repeatably positioning ordinary removable hairpieces, thereby eliminating the problems just described. Despite the fact that removable hairpieces have been in use for literally thousands of years, the problem of making them undetectable has never been solved.

One major object of the instant invention is to provide an apparatus and method for positioning a hairpiece on the wearer's head with the extreme precision required to make it undetectable.

Another object of the invention is to make the aforementioned positioning activity simple and rapid, rather than frustrating and time consuming.

Another object of the invention is to enable the wearer to utilize relatively inexpensive hairpieces, rather than expensive custom made hairpieces.

Another object of the invention is to increase the effective life of hairpieces.

Another object of the invention is to enable the wearer to use a plurality of different hairpieces for different seasons of the year, different occasions, different acting roles, etc.

Another object of the invention is to provide a method for delineating the edges of a hairpiece for purposes of shaving or coloring sideburns, applying makeup, etc.

Further objects of the invention will become apparent from the following description and accompanying drawings.

DESCRIPTION OF THE PREFERRED EMBODIMENTS

Figure 1:
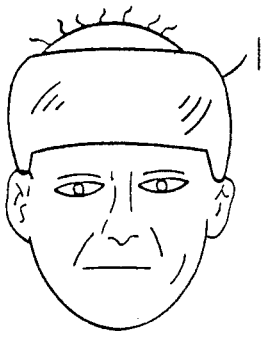
FIG. 1 shows the movable surface fitted to the head of the wearer.
Figure 10:
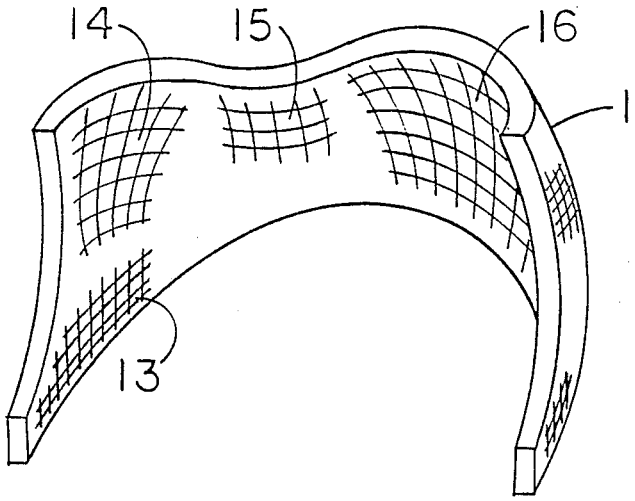
FIG. 10 shows the inside of the movable surface with the convolutions which serve as juxtaposing means.

The first step in implementing the instant invention is to fabricate a relatively rigid movable surface, hereinafter referred to simply as the "movable surface", which can be juxtaposed in an extremely precise and unique fixed position relative to the wearer's head. FIG. 1 shows a preferred form of the invention in which this movable surface (1) is a partial negative mask of a portion of the wearer's head. It may be constructed, for example, of plaster of paris, gauze impregnated with plaster of paris, plastic, hardened clay, etc., and normally need only include the wearer's temples and the forehead up to and slightly above the new artificial hairline which is to be established by the hairpiece, although it could utilize other portions of the wearer's head. The exact thickness is not too important as long as the movable surface is relatively rigid. A thickness of 1/8th to ¼ inch has been found to be satisfactory. After fabrication, the movable surface may be coated with an acrylic medium or other similar material to improve rigidity and/or prevent flaking. The required extremely precise and unique position relative to the wearer's head in which the movable surface must be juxtaposed is preferably achieved inherently by the fabrication technique used to make the movable surface. When the plaster of paris, gauze impregnated with plaster of paris, plastic, clay, etc. hardens, it assumes the exact shape of the wearer's head, following precisely every surface variation and convolution thereof. Thus, when the movable surface is removed and then later replaced, it will lock back into these surface variations and convolutions in exactly the same way, thus repetitively providing the required precise and unique juxtaposition relative to the wearer's head. This is illustrated in FIG. 10, which shows the inside of the movable surface (1) with typical surface variations and convolutions (13, 14, 15, 16).

It is also possible to make a positive mask from the original negative, for example out of plaster of paris, and then make a final negative movable surface conform to the positive mask. However, because of its relative simplicity, the preferred method is to use the one step process wherein the original negative mask is used as the movable surface.

Next, the movable surface is temporarily removed and put aside. The hairpiece to be worn by the wearer is then placed on the head and fastened in place. This is usually accomplished with double sided adhesive tape, but can also be done in other ways, for example with internal elastic bands. This latter method is less satisfactory, because the hairpiece can sometimes slide with respect to the head. It is very important at this time that the hairpiece be placed on the head precisely and correctly. With a new hairpiece, this would normally be done by the hair stylist from whom the hairpiece is purchased, since the purchase price normally includes the initial cutting and styling. For an existing hairpiece, the wearer should either have a professional put it on, or, using his own previous experience with the hairpiece, be very careful in putting it on himself.

One useful test to see if the hairpiece is positioned optimally is to displace the hair slightly at various points on the head by pushing, pulling, crushing, etc., while the overall position of the hairpiece remains fixed. If the hairpiece is correctly positioned, it will still look realistic after these displacements, whereas if the positioning is not optimal the slightest displacement will cause the hairpiece to look artificial. This "variational test" is an application of a mathematical principle commonly employed in the calculus of variations, where small changes in the independent variables about an extremum do not result in any first order changes in the quantity being measured, in this case detectability.

The reason this first fitting is so important is that the instant invention will always cause the hairpiece to be placed exactly as it is for the initial fitting, so if it is wrong the first time, it will always be wrong, although as will be seen, some corrections are possible. At this first fitting it is particularly important to avoid compensating for poor placement by fluffing, brushing, etc., because the latter actions, as mentioned earlier, will not hold up. In fact, the opposite should be done; the "variational test" described above should be employed.

Regardless of who puts on and styles the hairpiece for this initial fitting, it is a good idea for the wearer to then go out in public, walk around a store or shopping center, sit down in a restaurant, etc., and observe the reactions of the public. If the hairpiece does not look realistic, the obvious stares of the public will soon let the wearer know about it.

Figure 2:
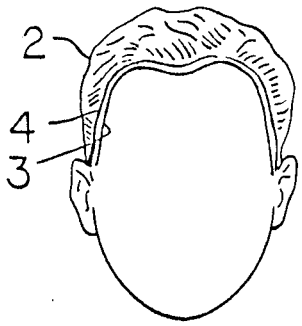
FIG. 2 shows the marking made on the head of the wearer in fixed relationship to the correctly positioned hairpiece.

Assuming that the initial fitting passes the test, we are ready for the next step. Referring to FIG. 2, with the hairpiece (2) left in place and using a transferable material such as lipstick or grease makeup crayon, a continuous line (3) is drawn on the head of the wearer at the edge of the base (4) of the hairpiece all across the forehead and, where applicable, down the temples. This line (3) marks the exact position of the edge or the base (4) of the hairpiece.

In marking the transferable line (3) on the head of the wearer, care should be taken that the marking material is not applied to the edges of the hairpiece itself. This might cause unsightly stains which may be difficult to remove. This problem can be avoided by at least two methods.

One method is to have the marking material, e.g. lipstick, in a thin tube made of metal or plastic, with the marking material just extending slightly from the end of the tube. In this way the metal or plastic tube presses against the edge or base of the hairpiece, and the base and/or hair does not contact the marking material directly.

A second and preferred method is to first draw the line (3) on the head of the wearer with a relatively nontransferable material such as a dermatographic pencil commonly sold by theatrical makeup suppliers. The hairpiece is then removed and the line (3) is traced over with the transferable material such as lipstick or grease makeup crayon. It is desirable for the transferable material to make a relatively transparent line so that the original line which is being traced can always be seen. Lipstick works well, but other transferable materials are also suitable.

If the base of the hairpiece does not extend fully down the temples of the wearer, or if the base has breaks in it, the line(s) can be continued at the hairline or in some fixed relationship to the hairpiece.

Figure 3:
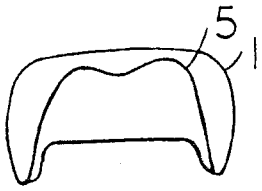
FIG. 3 shows the marking transferred to the movable surface from the head of the wearer.
Figure 4:
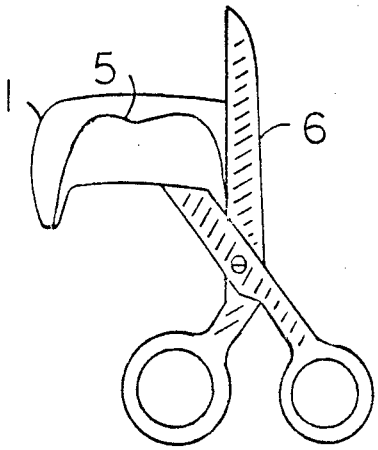
FIG. 4 shows the movable surface being cut in fixed relationship to the marking thereon.

Next, the hairpiece is preferably removed if this has not already been done, and the movable surface which was previously put aside is now placed back in its original exact and unique position with respect to the head of the wearer. The movable surface is now pressed against the head of the wearer, and then removed. Referring to FIG. 3, the mark previously placed on the forehead using the transferable material is now seen as a transferred mark (5) on the inside surface of the movable surface (1). Referring to FIG. 4, the movable surface (1) is now cut into two pieces along, or in some fixed relationship to, the transferred mark (5) using a pair of scissors (6), or a small hand or electric saw, etc. The latter terminology "in some fixed relationship to" refers to the fact that with some marking means the thickness of the marking means may cause the line drawn on the head of the wearer to be displaced slightly from the edge of the hairpiece so that one may wish to allow for this in cutting the movable surface.

Figure 5:
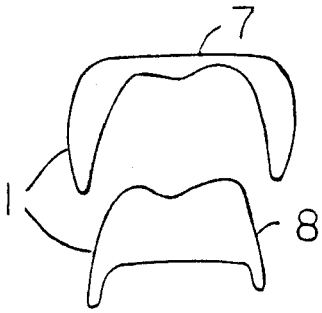
FIG. 5 shows the movable surface after it has been cut to form a movable member plus a portion which is discarded.

FIG. 5 shows the movable surface (1) after is has been cut into an upper part (7) and a lower part (8). The upper part (7) of the movable surface is then discarded, and the lower part (8) is retained. Since the upper part (7) is discarded and is of no further use, the term "movable member" will now be used to refer to the remaining lower part (8) of the original movable surface (1). It is good practice to also coat the edge of the cut just made on the movable member (8) with an acrylic or other medium to prevent chipping or flaking.

Figure 9:
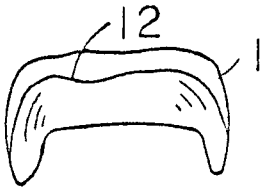
FIG. 9 shows the movable surface with a marking thereon which serves as positioning means.

While the preferred form of the invention is to cut the movable surface to obtain the movable member as just described, referring to FIG. 9 it is also possible to place a marking (12) on the outside of the movable surface to indicate the edge or base of the hairpiece. This marking can be made using the line (5) on the inside of the movable surface as a guide, or it may be made directly on the movable surface with the hairpiece in place. In this case, the movable surface, after the marking (12) has been placed thereon, then becomes the movable member. This marking (12) can then be used to align the hairpiece in a manner described below.

The mark or marks which were placed on the forehead and temples of the wearer are now wiped off the wearer's head, and the preparation of the movable member (8) is complete.

If desired, instead of placing the transferable mark directly on the wearer's skin, a temporary intermediate surface, such as adhesive tape, may be placed on the skin and the transferable mark placed thereon. This eliminates the necessity of wiping the mark off the wearer's head, since the intermediate surface can simply be removed at this point. All references herein to "placing a marking or markings on the wearer's head" should be interpreted as including the case where such an intermediate surface is used.

Figure 8:
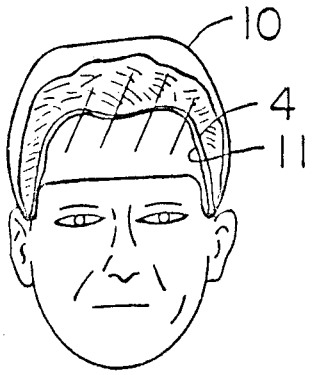
FIG. 8 shows a transparent movable surface fitted to the head of the wearer.

An alternative method of marking the movable surface in lieu of using transferable marking means is to make the movable surface out of transparent material, such as plastic, and leave the hairpiece in place. Referring to FIG. 8, the transparent movable surface (10) is placed in position on the head of the wearer, and the edge or base (4) is then visible through the transparent movable surface (10). The edge or base line can then be traced on the outside of the transparent movable surface. This traced line (11) may be made with a dermatographic pencil or other means. The traced line (11) is shown in FIG. 8 as slightly displaced from the edge or base line (4) of the hairpiece for purposes of clarity. In practice, of course, the two lines would be coincident.

After marking the transparent movable surface, the marking (11) on the movable surface may now be utilized in at least two ways. In the first, the movable surface is cut along the marking just as in the previous method where the marking was transferred from the transferable marking on the head, thereby generating the movable member directly as before. In the second, the movable surface is not cut, but the marking on the transparent movable surface is utilized to align the hairpiece in a manner described below. In the latter case, the original movable surface with the marking thereon becomes, and is hereinafter included in the term "the movable member". In the latter case, if the marking on the transparent movable surface was made in such a manner that it is easily wiped off, it can now be made more permanent, for example by engraving, or by covering the original line with a more permanent marking means.

Figure 6:
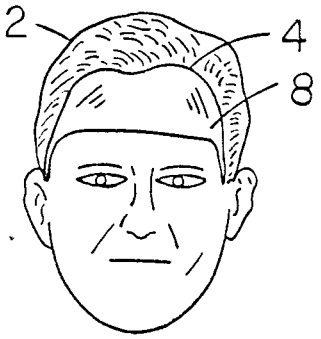
FIG. 6 shows the movable member juxtaposed on the head of the wearer while positioning the hairpiece.
Figure 7:
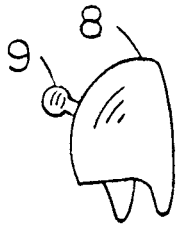
FIG. 7 shows the movable member being removed after positioning the hairpiece.

Regardless of the exact embodiment of the movable member used, it must allow a hairpiece simultaneously placed on the head to be varied in position. The invention may now be utilized any time the wearer desires to put on his hairpiece. Referring to FIG. 6, this is accomplished as follows: The hairpiece (2) is placed loosely on the head in approximately the correct position. The movable member (8) is then held in position on the wearer's forehead. Because of the manner in which the movable member is constructed, this position is fixed and unique. In the preferred embodiment where the movable surface was actually cut to form the movable member, the edge or base (4) of the hairpiece (2) is now butted up against the edge of the movable member (8), which action places the hairpiece in exactly the same position in which it was originally placed by the hair stylist. The hairpiece is then pressed against the head at those points where the usual double sided adhesive tape is located, thereby affixing the hairpiece to the head in the correct position. Or, if means other than adhesive tape (such as elastic bands) are used to keep the hairpiece in place, the hairpiece is simply left in the position previously determined by the movable member. The movable member is then removed and stored for the next usage. This may be done by simply grasping the movable member and removing it from the head, or, referring to FIG. 7, a special protrusion in the form of a handle or knob (9) may be permanently or temporarily attached to the movable member (8) to facilitate its handling and removal.

While it is desirable to fabricate the movable member precisely so that it butts directly against the edge or base of the hairpiece, small errors can usually be corrected during use. The wearer can feel a small gap or overlap at certain points between the hairpiece and the movable member, and, by becoming accustomed to the feel of this small gap or overlap, still position the hairpiece correctly.

In the embodiment where the movable surface was not cut, but a marking was placed on the outside of the movable surface corresponding to the edge or base of the hairpiece, the edge or base of the hairpiece is simply aligned with this outside marking.

In the embodiment where the movable member is transparent and is not actually cut along the marking thereon, the movable member and the hairpiece are placed on the head and the hairpiece is positioned so that it aligns with the mark on the transparent movable member. The hairpiece is then left in position as before and the movable member removed.

In another embodiment of the invention which is applicable to a manufacturing operation, the hairpiece could be manufactured with a pliable unformed movable surface removably attached to the hairpiece, for example at the edge of the base. After the hairpiece is correctly positioned, the unformed pliable movable surface is attached to the hairpiece and then pressed against the head of the wearer to conform it to the shape of the wearer's head. The movable surface, which would now also be the movable member, thus formed could then be baked or heated, or otherwise treated, or a duplicate could be made thereof, as may be required to make it rigid. This embodiment is basically the same as before, except that the order of initial positioning of the hairpiece and fabrication of the movable member is reversed.

The movable member, which has thus far been described as a device for positioning a hairpiece correctly, has several other unique uses relating to the problem of making hairpieces undetectable.

Some men prefer to allow their own natural sideburns to extend beyond the edges of the hairpiece so that the sideburns show. On the other hand, many prefer that their sideburns be completely covered by the hairpiece. In the latter case there is a potential problem in that the edges of the sideburns may show while the hairpiece is being worn thereby possibly leading to detection of the hairpiece. This is particularly true if the color of the sideburn hair differs from that of the hairpiece. It is desirable, therefore, that the wearer either shave off a sufficient amount of the sideburn so that it does not show when the hairpiece is being worn, or that he color the sideburn hair with a makeup pencil or similar device to match the color of the hairpiece.

In the first case, where a portion of the sideburn is to be shaved off, a problem arises as to how much of the sideburn should be shaved. If the wearer does not shave enough of the sideburn off, it will still show when the hairpiece is being worn. On the other hand, if too much is shaved off, not enough hair will be available to grip the double sided adhesive tape used to hold the hairpiece in place, possibly leading to detection of the hairpiece. (The adhesive tape grips short sideburn hair better than closely shaved skin.) To solve this problem, the wearer could put on the hairpiece correctly, mark his head at the edges of the hairpiece with a dermatographic pencil, remove the hairpiece, and shave the sideburn up to the line thus drawn. This method has several disadvantages. First, the hairpiece must be positioned correctly, only to be subsequently removed, a waste of time and effort. Secondly, if the head is repeatedly marked along the edge of the hairpiece every time the hairpiece is worn, the edge of the hairpiece is likely to eventually become soiled and/or damaged.

These difficulties can be avoided by utilizing the movable member, whose two most important characteristics are: (1) it can be juxtaposed in a fixed and unique relationship to the head of the wearer, and (2) it delineates the line of the edge or base of the hairpiece.

Therefore, without having to put the hairpiece on at all, the wearer can hold the movable member in place, mark the edges of the sideburns, for example with a dermatographic pencil, and remove the movable member. The area to be shaved is then clearly delineated by the marking thus made.

The same procedure can be followed in the case where the wearer prefers to color the sideburn hair with a makeup pencil to match the hairpiece. While this can be done with the hairpiece itself in place, after repeated coloring the hairpiece is likely to become soiled and/or damaged. By following the procedure just described, the area of the sideburn to be colored is clearly delineated.

The movable member can similarly be utilized to delineate the area of the face to which makeup can be applied. This utilization is likely to be most useful to women or to men in acting roles, although everyday makeup for men has achieved some acceptance. In applying makeup, if the makeup does not cover the face right up to the edge of the hairpiece, it leaves an unsightly gap which could attract attention and lead to closer scrutiny and possible detection of the hairpiece. On the other hand, if the makeup is applied too far beyond the edge of the hairpiece, it could interfere with proper adhesion of the tape holding the hairpiece, and/or it could soil the hairpiece. By utilizing the movable member to delineate and mark the edge of the hairpiece, as previously described, the area to which makeup should be applied is clearly delimited.

If one desires to put hair spray on the hairpiece to hold the hair in place, the movable member can also be used as a spray shield. Since the movable member substantially covers portions of the head immediately adjacent to the hairpiece, any excess spray will simply strike the outside of the movable member rather than the wearer's skin.

While the instant invention is most useful in its application to men's hairpieces because of their greater inherent detectability, it can be seen that it applies to women's hairpieces as well. At the very least, it provides women with a rapid and trouble free method for putting on a hairpiece correctly, and, as just discussed, delineates the area where makeup can be applied and/or serves as a spray shield.

In the case of both men and women, use of the instant invention provides confidence that each day the hairpiece is positioned correctly. It can be appreciated, as was previously mentioned, that even if the hairpiece is put on incorrectly one time, then the spell is broken, so to speak, and people will know that a hairpiece is being worn. Even if the hairpiece is put on correctly thereafter, it will be difficult or impossible to dispel the belief that the hair is artificial.

By making use of the instant invention, it is frequently possible for the wearer to successfully use relatively inexpensive stock hairpieces rather than carefully crafted custom hair pieces which cost many times as much and which, used alone without the instant invention, are usually ineffective.

The instant invention also makes it possible for the wearer to have a plurality of hairpieces, either for backup purposes, or, with different hair styles, for different seasons of the year or different occasions, etc., or for different acting roles. With a separate movable member for each hairpiece, it is very easy to switch from one hairpiece to another without trying to remember how each should be placed in position.

Use of the instant invention can also increase the effective life of a hairpiece. Formerly, people discarded hairpieces after relatively short periods of use because they equated wear and detectability. As indicated above, once the positioning problem has been taken care of by the instant invention, there is no reason why a hairpiece should be discarded. A well constructed hairpiece can easily last five to ten years or more with a minimum of care.

Although I have described several embodiments and uses of my invention, it is obvious that variations, other than those discussed, may be made without departing from the true spirit and scope of the invention.

I claim:

1. A movable member for aiding in positioning a hairpiece on the human head, said movable member comprising:

(a) juxtaposing means, said means having surface variations and convolutions matching those of said head, whereby said movable member may be juxtaposed against said head in fixed and unique relationship thereto, (b) positioning means matching the contour of the base or edge of said hairpiece, which, when said movable member is juxtaposed against said head in said fixed and unique relationship thereto, enables said hairpiece to be simultaneously positioned on said head together with, and in fixed relationship to, said movable member.

2. The movable member of claim 1, wherein said movable member is a mask conforming to a portion of said human head.

3. The movable member of claim 2, wherein said mask is made of plaster of paris.

4. The movable member of claim 2, wherein said mask is made of gauze impregnated with plaster of paris.

5. The movable member of claim 2, wherein said mask is made of clay.

6. The movable member of claim 2, wherein said mask is made of plastic.

7. The movable member of claim 1, wherein said positioning means is the edge of said movable member.

8. The movable member of claim 1, wherein said positioning means is a marking on said movable member.

9. A method for aiding in making a hairpiece undetectable on the human head, comprising the steps of:

(a) fabricating a movable member, said movable member comprising a juxtaposing means for holding said movable member in fixed and unique relationship to said head and a positioning means for positioning said hairpiece in fixed relationship to said movable member, (b) placing said movable member said head in said fixed and unique relationship to said head, (c) positioning said hairpiece on said head in said fixed relationship to said movable member by means of said positioning means, (d) removing said movable member from said head, leaving said hairpiece in position on said head.

10. The method of claim 9, wherein said movable member is fabricated by:

(a) fabricating a movable surface, (b) correctly positioning said hairpiece on said head, (c) placing a transferable marking on said head in fixed relationship to said hairpiece, (d) juxtaposing said movable surface in its fixed and unique relationship to said head, (e) transferring said transferable marking to said movable surface, (f) cutting said movable surface in fixed relationship to the transferred marking thereon, thereby creating said movable member, whereupon the edge of said movable member serves as said positioning means.

11. The method of claim 10, wherein said transferable marking is derived by:

(a) first placing a relatively nontransferable marking on said head in fixed relationship to the correctly positioned hairpiece, (b) removing said hairpiece, (c) placing said transferable marking on said head in fixed relationship to said nontransferable marking.

12. The method of claim 9, wherein said positioning means is a marking on a movable surface, said marking converting said movable surface to said movable member.

13. The method of claim 9, wherein said movable member is transparent and is fabricated by:

(a) fabricating a transparent movable surface, (b) correctly positioning said hairpiece on said head, (c) placing said transparent movable surface on said head in its fixed and unique relationship to said head, (d) placing a marking on said transparent movable surface, said marking being aligned with the base or edge of said hairpiece, thereby creating said movable member, whereupon said marking serves as said positioning means.

* * * * *